US006638083B2

(12) United States Patent
Rhude

(10) Patent No.: US 6,638,083 B2
(45) Date of Patent: Oct. 28, 2003

(54) MALE PLUG PROTECTOR FOR TRAILER WIRING HARNESS

(76) Inventor: Douglas R. Rhude, 22382 S.R. 120, Elkhart, IN (US) 46516

( * ) Notice: Subject to any disclaimer, the term of this patent is extended or adjusted under 35 U.S.C. 154(b) by 0 days.

(21) Appl. No.: 10/073,412

(22) Filed: Feb. 13, 2002

(65) Prior Publication Data

US 2002/0142637 A1 Oct. 3, 2002

Related U.S. Application Data

(60) Provisional application No. 60/279,667, filed on Mar. 30, 2001.

(51) Int. Cl.[7] ..... H01R 33/00
(52) U.S. Cl. ..... 439/142; 439/35
(58) Field of Search ..... 439/35, 34, 142; 220/242; 307/10.1, 10.8

(56) References Cited

U.S. PATENT DOCUMENTS

| | | | | |
|---|---|---|---|---|
| 3,176,257 A | | 3/1965 | Introvigne | |
| 3,482,203 A | | 12/1969 | Whitright | |
| 4,017,136 A | | 4/1977 | Sassgen | |
| 4,738,641 A | | 4/1988 | Eversole, Jr. | |
| 4,770,644 A | | 9/1988 | Feder | |
| 5,380,209 A | | 1/1995 | Converse, Jr. et al. | |
| 5,443,389 A | * | 8/1995 | Hughes | 439/35 |
| 5,501,607 A | * | 3/1996 | Yoshioka et al. | 439/142 |
| 5,630,728 A | | 5/1997 | Watters, Jr. | |
| 5,722,854 A | | 3/1998 | Geisler | |
| 5,800,188 A | | 9/1998 | Barber et al. | |

* cited by examiner

*Primary Examiner*—Renee Luebke
*Assistant Examiner*—Felix O. Figueroa
(74) *Attorney, Agent, or Firm*—Richard C. Litman

(57) ABSTRACT

A vertically oriented, male plug protector for a trailer wiring harness connection plug having a female type receptacle with a spring-biased hinged cover at its lower end. The upper end is closed. The device has a back plate for mounting to a trailer near the hitch end. When the trailer is not in use, the cover is pulled back and the male wiring harness plug is inserted. The male plug end is retained in the protector by the spring action of the cover and a protrusion on the interior of the cover corresponding to a projection located on the male plug wall. To remove the plug, the user pulls back the cover and removes the plug. The electrical wiring harness plug is retained within the protector to prevent environment damage from occurring to the plug's electrical connectors when the trailer is not in use.

19 Claims, 5 Drawing Sheets

MALE PLUG PROTECTOR FOR TRAILER WIRING HARNESS

CROSS-REFERENCE TO RELATED APPLICATION

This application claims the benefit of U.S. Provisional Patent Application Ser. No. 60/279,667, filed Mar. 30, 2001.

BACKGROUND OF THE INVENTION

1. Field of the Invention

The present invention relates to electrical plug protectors. More particularly, the present invention relates to a male plug protector for a trailer wiring harness connection plug.

2. Description of Related Art

When disconnecting a trailer from a towing vehicle, it would be helpful to provide a device mounted on the trailer in which the male plug of the trailer may be stored when the trailer is not in use. The device should provide a relatively snug fit while protecting the electrical plug from exposure to the weather, etc.

U.S. Pat. No. 3,176,257, issued Mar. 30, 1965 describes a bracket for holding trailer plugs of tractor-trailer vehicles. The plug holder '257 patent is designed to rotatably receive a specific type of plug, and the plug holder has no covering to keep out dust, etc.

U.S. Pat. No. 3,482,203, issued Dec. 2, 1969, to Whitright describes an electrical connector storing device for trailers. This device has no cover for protection to keep out dust, etc. when not in use, and relies on a ring or bail to hold the male connector. The ring device requires a particular type of plug shape where it is attached to the wire conduit in order to maintain the plug in the hood or protector.

U.S. Pat. No. 4,017,136, issued Apr. 12, 1977 to Sasgen, describes a male plug holder for holding a plug for a locomotive control cable when not in use. The male plug holder is oriented in a forward position, thus allowing rain or other environmental hazards into the plug. The plug holder of the '136 patent is designed for a particular plug for a train locomotive and would not be practical for vehicle-pulled trailer connectors.

U.S. Pat. No. 4,738,641, issued Apr. 19, 1988, to Eversol, Jr., describes a spring loaded trailer electrical connector protector device for protecting male trailer connectors when not in use. The '641 device requires wings which fit into notches at the lower end of the device which is an uncommon feature on trailer connectors.

U.S. Pat. No. 4,770,644, issued Sep. 13, 1988, to Feder, describes a typical trailer plug connector of the type contemplated by the present invention and a receiving female connector having a hinged spring cover.

U.S. Pat. No. 5,380,209, issued Jan. 10, 1995, to Donvers, Jr. et al. describes a trailer connector housing which has an upward opening lid and side slots to receive electrical wires, and, a screw-on protector and casing for attachment to the vehicle. The trailer connector housing of the '209 patent is subject to entrance of environmental rain or dust.

U.S. Pat. No. 5,630,728, issued May 20, 1997, to Watters, Jr., describes a plug holder for trailers or towing vehicles. The '728 holder is vertically or horizontally mounted, allowing entrance of rain or mud, and is keyed to a particular connector.

U.S. Pat. No. 5,722,854, issued Mar. 3, 1998, to Geisler, describes a sleeve type trailer plug holder having an end cap for sealing the open end. The '854 device requires a snug fit between the plug holder and the trailer plug. The end cap must be inserted to assure protection from the elements. The end cap is subject to accidental removal, allowing the elements to enter the plug holder. The user may also forget to fasten the end cap securely.

U.S. Pat. No. 5,800,188, issued Sep. 1, 1998, to Barber et al., describes a trailer tow inter-connector having a spring-loaded cover similar to that of the present invention.

None of the above inventions and patents, taken either singly or in combination, is seen to describe the instant invention as claimed.

SUMMARY OF THE INVENTION

The present invention is a vertically oriented male plug protector for a trailer wiring harness connection plug having a female type receptacle with a spring-biased hinged cover at its lower end. The upper end is closed. The device has a back plate with mounting holes for mounting to a trailer near the hitch end. When the trailer is not in use, the cover is pulled back and the male wiring harness plug is inserted into the female receptacle. The male plug end is retained in the protector by the spring action of the cover and a protrusion on the interior of the cover corresponding to a projection located on the male plug wall. To remove the plug, the user pulls back the cover and removes the plug. The electrical wiring harness plug is retained within the protector to prevent environment damage from occurring to the plug's electrical connectors when the trailer is not in use. The protector has no electrical connections.

Accordingly, it is a principal object of the invention to provide a protector apparatus for safe storage of a male electrical plug for a trailer.

It is another object of the invention to provide a plug protector as above which mounts on the front wall of a trailer.

It is a further object of the invention to provide a plug protector as above where the male plug is inserted upward into the protector and the protector completely encloses the upper portion of the plug.

Still another object of the invention is to provide a plug protector as above having a biased, hinged lower cover which may be pulled open to allow entry of the male plug, and then partially allowed to close by spring bias to retain the male plug within the plug protector.

It is yet a further object of the invention to provide a plug protector as above having tabs on the spring biased cover which may be employed to release the male plug for withdrawal, and then released to allow the spring biased cover to closing over the lower portion of the plug receptacle to avoid entry of dirt, etc.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a vertically oriented, male plug protector for a trailer wiring harness connection plug having a female type receptacle with a spring-biased hinged cover at its lower end. The upper end is closed. The device has a back plate with mounting holes for mounting to a trailer near the hitch end. When the trailer is not in use, the cover is pulled back and the male wiring harness plug is inserted. The male plug end is retained in the protector by the spring action of the cover and a protrusion on the interior of the cover corresponding to a projection located on the male plug wall. To remove the plug, the user pulls back the cover and removes the plug. The electrical wiring harness plug is retained within the protector to prevent environment damage from occurring to the plug's electrical connectors when the trailer is not in use. The protector has no electrical connections.

Figure 1:
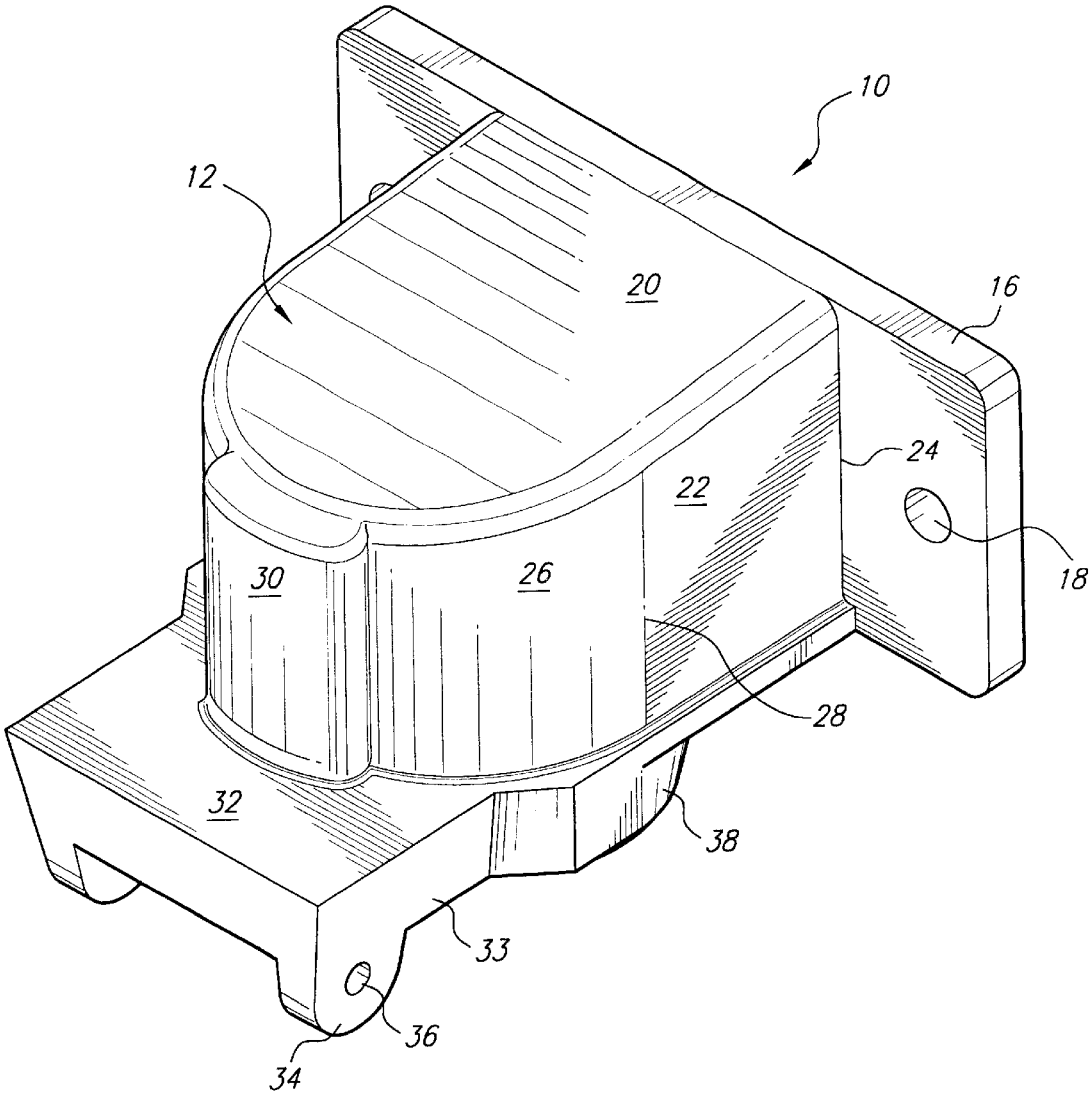
FIG. 1 is a perspective view of a male plug protector for trailer wiring harness according to the present invention with the lower lid removed.
Figure 2:
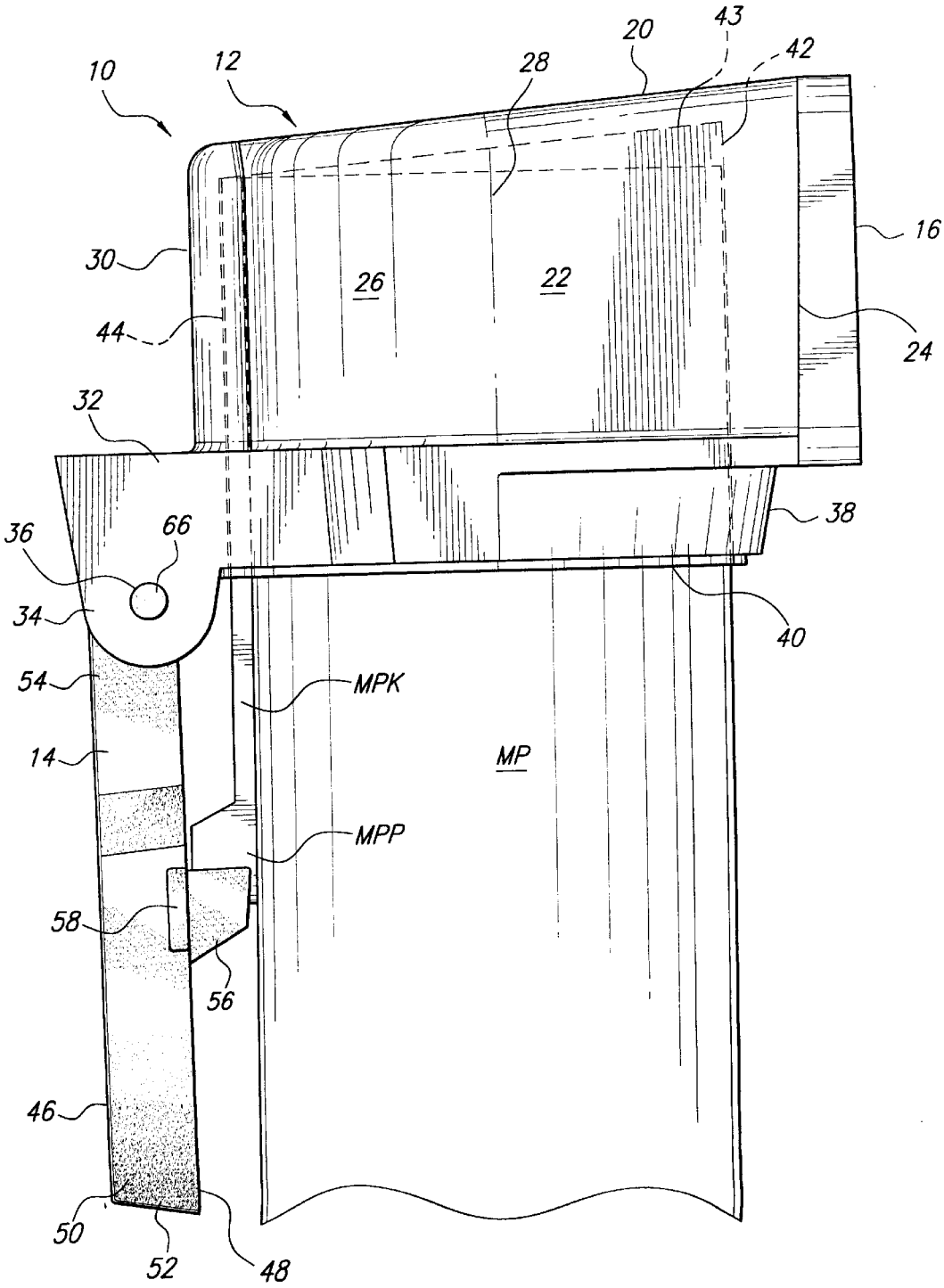
FIG. 2 is a side view in elevation of the present invention shown with a male plug inserted therein.

Referring to FIGS. 1–4, various perspective views of plug protector 10 are shown wherein plug protector 10 comprises vertically oriented male plug receptacle 12, having a spring biased, hinged lower cover 14 (see FIG. 2). Receptacle 12 has a vertically oriented back plate 16 having mounting holes 18 for mounting on a sidewall of a trailer, etc. Plug receptacle 12 has a top portion 20 acting as a closed, fixed upper wall for receptacle 12 and extending to said back plate 16 for additional support.

Receptacle back plate support walls 22 are vertically oriented and normal to said back plate 16 and extend from support wall back plate connections 24 to respective tangential intersections 28 on vertically oriented receptacle cylindrical portion 26 at the respective ends of a diameter parallel to said back plate 16, said support walls 22 connecting along cylindrical portion 26 at support wall cylindrical intersections 28.

Receptacle top portion 20 covers said cylindrical portion 26 and extends between support walls 22 and said back plate 16, thus forming an inverted "U"-shaped support between said cylindrical portion 26 and said back plate 16. Cylindrical portion 26 of receptacle 12 has a groove portion 30 extending vertically along cylindrical portion 26 at a location opposite back plate 16. Receptacle lower plate 32 defines the lower end of cylindrical portion 26, and comprises lower plate extended portion 33 extending outward from said cylindrical portion 26 and which supports lower plate hinge portion 34 having axle receiver 36 for connection with spring biased, hinged cover 14.

Receptacle lower plate 32 includes lower plate plug receiving portion 38 opposite hinge portion 34 and includes lower plate under portion 39 (see FIG. 4) extending from the receptacle cylindrical portion 26 to back plate 16, forming a boxlike structure with receptacle back plate support walls 22 and receptacle top portion 20. Receptacle cylindrical portion 26 of lower plate 32 is cut away to form a semicircular portion extending from tangential intersections 28 to back plate 16, thus forming under portion 39. The lower plate plug receiving portion 38 of lower plate 32 serves as a lower extension of cylindrical portion 26 and forms lip 40 extending from bottom plate lower surface 41 at the lower opening inner cylindrical surface 42. The outer surface plug receiving portion 38 is conically shaped in its semicircular portion, tapering inwardly from lower plate under portion 39 to lower surface 41(see FIG. 4).

Figure 3:
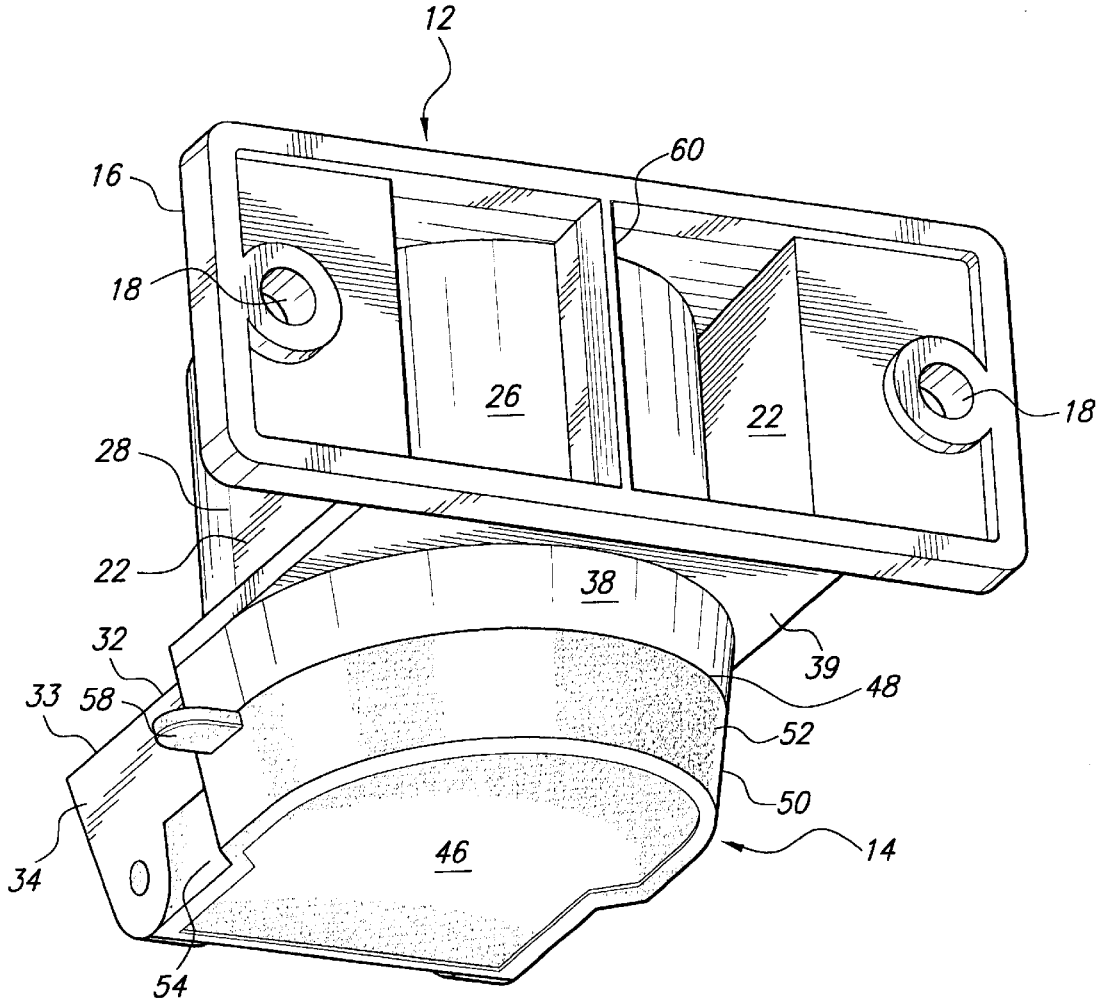
FIG. 3 is a bottom rear view in perspective of the present invention with the lower cover closed.

Referring particularly to FIGS. 2 and 3, there is shown a side view in elevation of the inventive plug protector 10 with a male plug inserted therein, and a bottom rear view in perspective of the present invention with the bottom cover closed, respectively. Male plug MP, having male plug key MPK, is shown inserted into receptacle cylindrical portion 26 along inner cylinder surface 42, having receptacle key receiver groove 44, formed within groove portion 30 and is sized and configured so as to receive male plug MP. Protrusion 56 protrudes from cover 14 (see FIG. 5) and is so configured as to interlock with male plug projection MPP, located at the base of key MPK, when male plug MP is inserted upward into receptacle 12 (see FIG. 2). Inner cylindrical surface 42 (see FIG. 4) and inner cylinder top surface 43 provide clearance for male plug MP. A lip 48 on hinged cover 14, forms an overlapping seal with cylindrical portion lip 40 when cover 14 is in the closed position.

Figure 4:
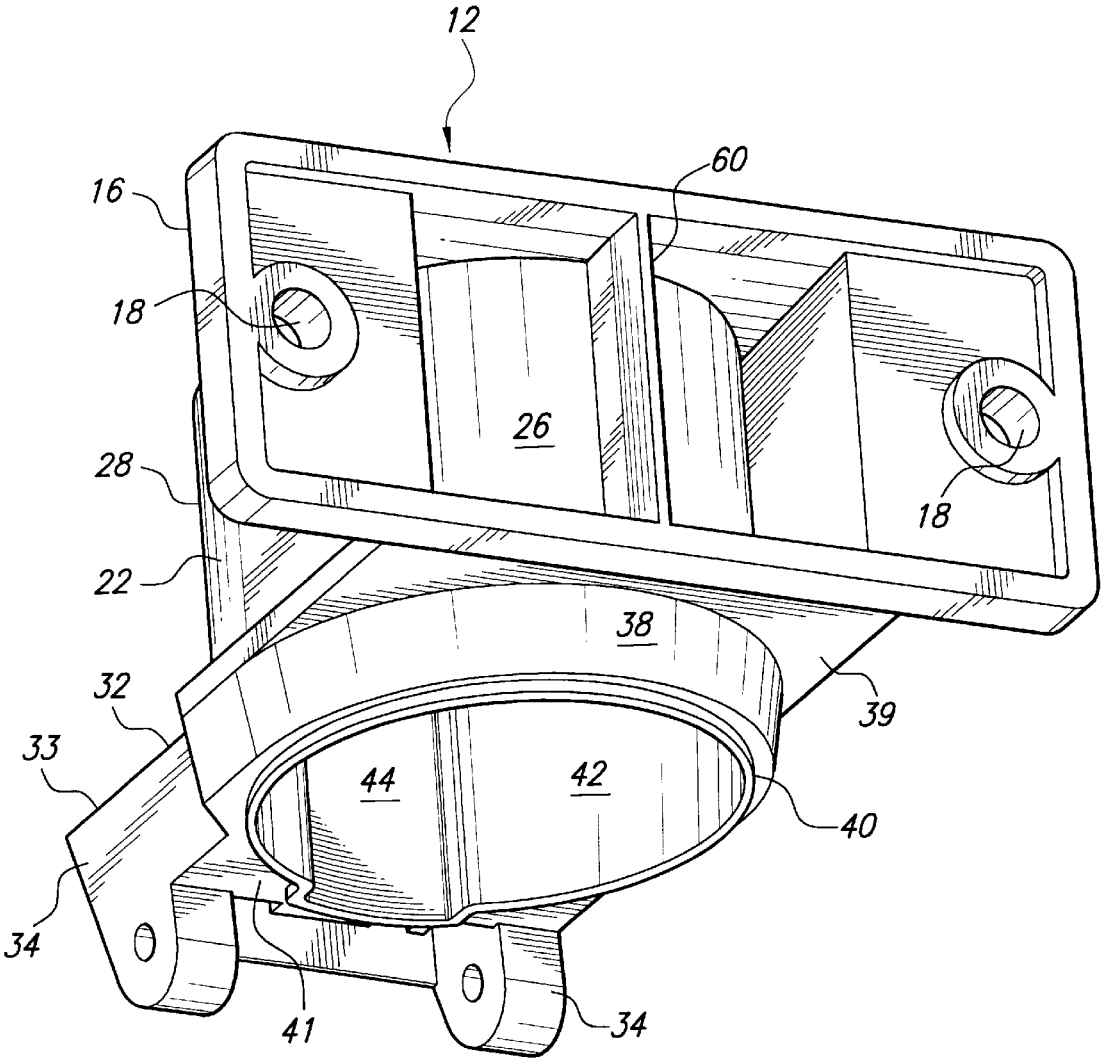
FIG. 4 is a bottom rear view in perspective of the present invention, absent the lower lid.

Referring, particularly, to FIG. 4, there is shown a bottom rear view of the plug holder 10 of the present invention without the hinged cover 14 and wherein receptacle cylindrical portion 26 features receptacle inner cylinder 42, having receptacle key receiver groove 44. Inner cylinder 42 is of such dimensions as to receive standard male electrical plug MP having a male plug key MPK and being useful for a trailer. Central support wall 60 is located parallel to back plate support walls 22 and extends between receptacle cylindrical portion 26, receptacle top portion 20, lower plate 29 and back plate 16. For ease of construction, the portion of the back plate between support walls 22, receptacle top portion 20 and lower plate 39 and receptacle cylindrical portion 26 may be deleted.

Figure 5:
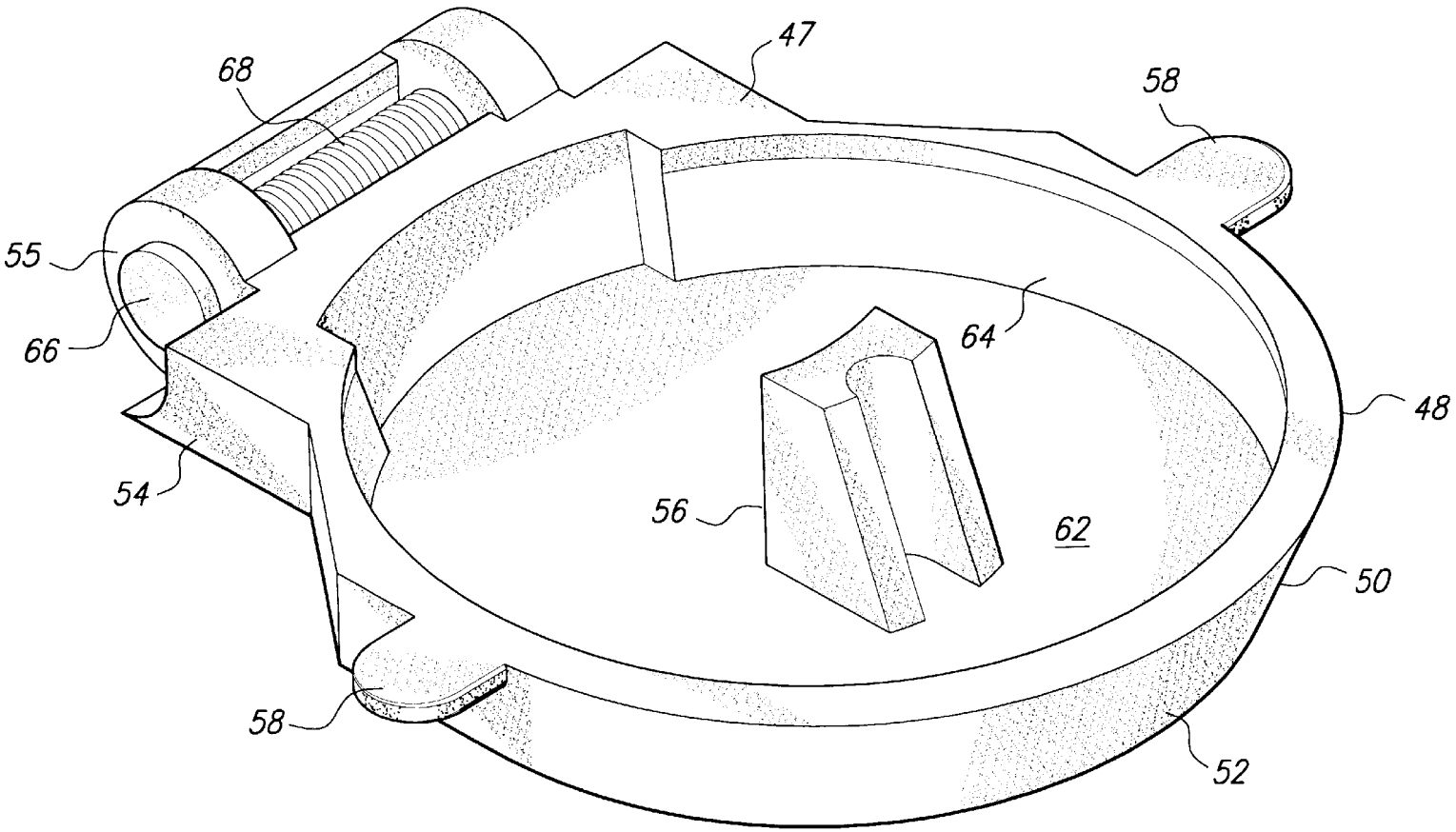
FIG. 5 is a perspective view of the bottom lid of the present invention showing the axle and spring which forms a hinge with the receptacle portion of the plug protector.

Referring to FIGS. 3 and 5, there are shown perspective views of the spring biased, hinged cover 14 of the present invention. Cover 14 is a generally flat plate having a plus receiver cover portion 50, an extended portion 54 and a hinge portion 55 and having a lower surface 46 and an upper surface 47, generally corresponding in shape to bottom plate lower surface 41. Plug receiver cover portion 50 is generally cylindrical, having an outer sidewall 52. The cover upper surface 47 defines a lip 48 surrounding a recess within plug receiving cover portion 50 and extended portion 54 and shaped for receiving lip 40 of lower plate receiving portion 38. The recess has inner end wall 62 at its base and is defined by hinged cover inner recess wall 64. Inner end wall 62 supports centrally located hinged wall protrusion 56 protruding upward from inner end wall 62 and which is so configured as to interlock with male plug projection MPP when male plug MP is inserted into receptacle 12 (see FIG. 2). Axle 66 is fixedly mounted within axle receiver 36 of lower plate hinge portion 34 and for rotation within cover hinge portion 55. Axle 66 is surrounded by hinge spring 68 and is so located and configured as to maintain a closing bias on hinged cover 14 in a known manner. Plug receiver cover portion outer sidewall 52 is conical in shape, tapering inwardly from cover upper surface 47 to lower cover outer wall 46. Inner recess wall 64 may be conical in shape, corresponding to outer sidewall 52. Pull tabs 58 are distributed around outer sidewall 52, extending outward from lower cover lip 48.

In operation, plug protector 10 is mounted in an appropriate place, such as a front wall of a trailer, by means of back plate 16 such that receptacle 12 may receive a standard male plug MP from below, i.e., receptacle cylindrical portion 26 is installed in a vertical orientation and spring biased, hinged cover 14 is hingedly attached at the base of the receptacle 12. Hinged cover 14 is opened so as to rotate around the axle 66 by pulling on hinged wall pull tabs 58 against the force of spring 68 to a male plug insert and removal position. Male plug MP is inserted upwards within receptacle inner cylinder 42 and along receptacle key receiver groove 44 until male plug projection MPP passes hinged wall protrusion 56 of spring biased, hinged cover 14. The bias from spring 68 allows projection 56 of cover 14 to close over male plug projection MPP to a male plug retention position, thus retaining male plug MP within the plug protector 10.

When it is desired to remove male plug MP from plug protector 10, spring biased, hinged cover 14 is pulled against the bias of spring 68 by means of pull tabs 58, until protrusion 56 of cover 14 clears the male plug projection MPP of male plug MP at the male plug insert and removal position. The male plug MP may then be withdrawn for connection with the towing vehicle or other source of electricity. The spring 68 automatically closes cover 14 such that lower cover upper surface 47 closes against lower plate lower surface 41 and lip 48 of cover 14 closes over lip 40 of lower plate plug receiving portion 38 of receptacle 12, thus sealing the protector against entry of dirt, etc.

It is to be understood that the present invention is not limited to the sole embodiments described above, but encompasses any and all embodiments within the scope of the following claims.

I claim:

1. A plug receptacle for protecting a cylindrical male plug of a trailer wiring harness, comprising:

a vertically oriented cylindrical portion;

a top portion integral with and covering said cylindrical portion;

said cylindrical portion and said top portion defining an inner cylindrical surface for receiving a cylindrical male plug;

said cylindrical portion having an open lower end;

a lower cover;

a spring biased hinge rotatably attaching said lower cover to the open lower end of said cylindrical portion for rotating said lower cover between an open position and a closed position;

a back plate for mounting said plug receptacle to a wall; and at least one vertically oriented support wall extending between said back plate and said cylindrical portion;

said back plate being spaced from said cylindrical portion by said at least one vertically oriented support wall.

2. The male plug receptacle of claim 1, wherein said back plate is vertically oriented so as to allow attachment to a vertical trailer wall.

3. The male plug receptacle of claim 1, wherein said lower cover includes a lower cover outer wall, a recessed inner end wall and a protrusion located on said inner end wall for cooperating with a radially extending projection of said male plug to lock said male plug within said plug receptacle once inserted therein, said cover being in the open position and biased against said male plug by said spring hinge.

4. The male plug receptacle of claim 1, said cylindrical inner surface defining a groove for receiving a key portion of said male plug when said lower cover is in the open position.

5. The male plug receptacle of claim 1, wherein said top portion is slanted upwards toward and extends to said back plate.

6. The male plug receptacle of claim 1, further comprising a lower plate integral with said cylindrical portion, said lower plate having a plug receiving portion, a hinge portion and an extended portion between said plug receiving portion and said hinge portion.

7. The male plug receptacle according of claim 6, wherein said plug receiving portion of said lower plate further defines said cylindrical inner surface and a groove for receiving a key portion of said male plug.

8. The male plug receptacle of claim 7, wherein said plug receiving portion of said lower plate has a downward extending lip surrounding said cylindrical inner surface and said groove.

9. The male plug receptacle of claim 8, wherein said lower plate extends to said back plate.

10. The male plug receptacle of claim 9, wherein there are two vertically oriented support walls extending from said cylindrical portion to said back plate, said support walls extending tangentially from diametrically opposing locations along said cylindrical portion, said diametrically opposing locations being at opposing ends of a diameter parallel to said back plate.

11. The male plug receptacle of claim 10, wherein said vertically oriented support walls extend from said plug receiving portion of said lower plate to said top portion of said plug receptacle.

12. The male plug receptacle of claim 11, further comprising a vertically oriented central support wall disposed on said cylindrical portion midway of said back plate.

13. The male plug receptacle of claim 12, wherein said hinge portion of said lower plate of said cylindrical portion is located opposite said back plate.

14. The male plug receptacle of claim 8, wherein said lower cover has an upper surface and a lower surface and comprises a plug receiver cover portion, a hinge portion, and an extended portion extending between said plug receiver cover portion and said hinge portion, said plug receiver cover portion and said extended portion having a recess therein defined by a lip formed by said upper surface for receiving said lower plate lip when said cover is in the closed position.

15. The male plug receptacle of claim 14, wherein said recess is further defined by an inner end wall and an inner recess wall extending between said inner end wall and said lower cover lip.

16. The male plug receptacle of claim 15, further comprising a protrusion located on said inner end wall for cooperating with a radially extending projection of said male plug to lock said male plug within said plug receptacle once inserted therein when said cover is in the open position and biased against said male plug by said spring hinge.

17. The male plug receptacle of claim 16, further comprising an axle connecting said lower plate hinge portion with said lower cover hinge portion.

18. The male plug receptacle of claim 17, further comprising a hinge spring positioned around said axle so as to bias said lower cover to said closed position.

19. The male plug receptacle of claim 18, further comprising a plurality of pull tabs spaced around and extending outward from said lower cover lip to allow a user to rotate said cover from the closed position to the open position against the bias of said hinge spring.

* * * * *